United States Patent [19]

Pignal et al.

[11] Patent Number: 4,767,252

[45] Date of Patent: Aug. 30, 1988

[54] MANIPULATOR FOR AUTOMATICALLY SUPPLYING MACHINES FOR THE CENTRIFUGATION OF BOBBINS OF YARNS

[75] Inventors: Maurice Pignal, Annoway; Bernard Chapuis, Lyons, both of France

[73] Assignee: Robatel SLPI, Genas, France

[21] Appl. No.: 46,397

[22] Filed: May 6, 1987

[30] Foreign Application Priority Data

May 9, 1986 [FR] France ..... 86 06875

[51] Int. Cl.[4] ..... B65H 1/00

[52] U.S. Cl. ..... 414/222; 414/750; 414/751; 68/23 R; 198/346.2

[58] Field of Search ..... 414/222, 749–751; 28/179, 180; 242/35.5 A; 68/23 R; 210/251, 770; 198/346.2

[56] References Cited

U.S. PATENT DOCUMENTS 1,949,278 2/1934 Johson ..... 210/251
4,545,135 10/1985 Barriquand et al. ..... 68/23 R X
4,615,493 10/1986 Teranishi et al. ..... 242/35.5 A

FOREIGN PATENT DOCUMENTS 97066 12/1983 European Pat. Off. ..... 68/23 R
3244925 6/1984 Fed. Rep. of Germany ..... 242/35.5 A

*Primary Examiner*—Robert J. Spar
*Assistant Examiner*—Jennifer L. Doyle
*Attorney, Agent, or Firm*—Dowell & Dowell

[57] ABSTRACT

This invention is directed to a manipulator for automatically supplying centrifuge machines for rotating bobbins of yarn in which the manipulator includes a carriage equipped with stop wings and tightening arms which grip the bobbins conducted to the carriage by a conveyor and wherein the carriage moves the bobbins to the baskets of the centrifuge machines and thereafter returns to its initial position while flaps mounted on the carriage cover the centrifuge machine as the bobbins are rotated therein and thereafter the flaps urge the bobbins from the centrifuge machines to a receiver plate.

10 Claims, 5 Drawing Sheets

1
2
3
4
5
6
7
8
9
10
11
12
13
13a
13b
13c
14
15
16
17
18
20
21
23
24
25
26
26a
27
28
29
30
30
31
31a
32
33
A

MANIPULATOR FOR AUTOMATICALLY SUPPLYING MACHINES FOR THE CENTRIFUGATION OF BOBBINS OF YARNS

BACKGROUND OF THE INVENTION

1. Field of the Invention

The present invention relates to machines for the centrifugation of bobbins, particularly bobbins of yarn, on leaving wet-process treatments such as dyeing, and has for its object a manipulator arranged so as to ensure, entirely automatically, loading and unloading of the rotating basket of one or more centrifugation machines.

2. Summary of the Invention

The manipulator according to the invention is constituted by a carriage animated, for example under the action of a double-effect jack, by a reciprocating horizontal movement which takes it from a moved back position of removal up to an advanced position lying above the opening of the rotating basket of the centrifuge machine envisaged. This carriage is provided with a handling mechanism comprising two adjustable wings adapted to form stops for successive bobbins to be spun, and two mobile arms adapted to open to allow application of each bobbin against the wings, and to close against the bobbin thereby rendering the bobbin secured to the carriage. The carriage further comprises an articulated flap associated with an actuation member which moves it from a horizontal orientation from which it obturates the upper opening of the centrifugation machine to a vertical position from which it forms a pusher for evacuating the bobbin extracted from the rotating basket of the centrifuge machine.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
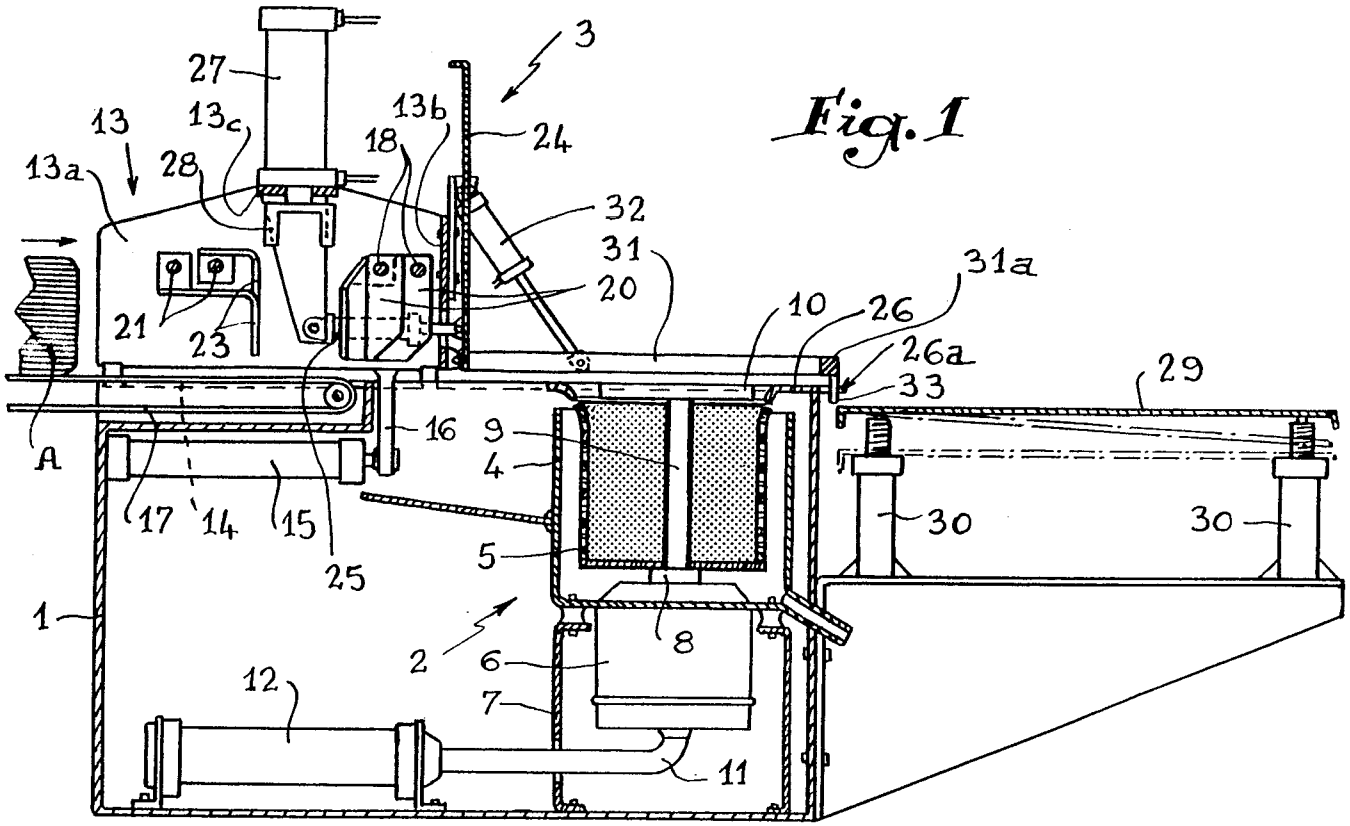
FIG. 1 is a vertical section showing the general arrangement of a manipulator according to the invention and of the centrifuge machine with which it is associated.

Referring now to the drawings, reference 1 of FIG. 1 designates the general frame of the installation formed by the centrifuge machine 2 and the manipulator 3 which ensures automatic supply thereof. As is known, particularly by French Pat. No. 83 11478 (2 549 867) to ROBATEL SLPI, the machine 2 comprises a fixed vessel 4 inside which rotates a basket 5 driven in rotation by an electric motor 6 carried by a base 7 of the frame 1. The shaft 8 of this motor 6 is hollow so as to leave room for an axial pusher 9 provided with an elevator plate 10 which slides freely in the basket 5 under the effect of an actuating member, assumed to be flexible in the embodiment shown and guided to this end inside an elbow 11. This member, rigid or flexible, is controlled in reciprocating motion by a pneumatic jack 12 of the double-effect type.

Figure 2:
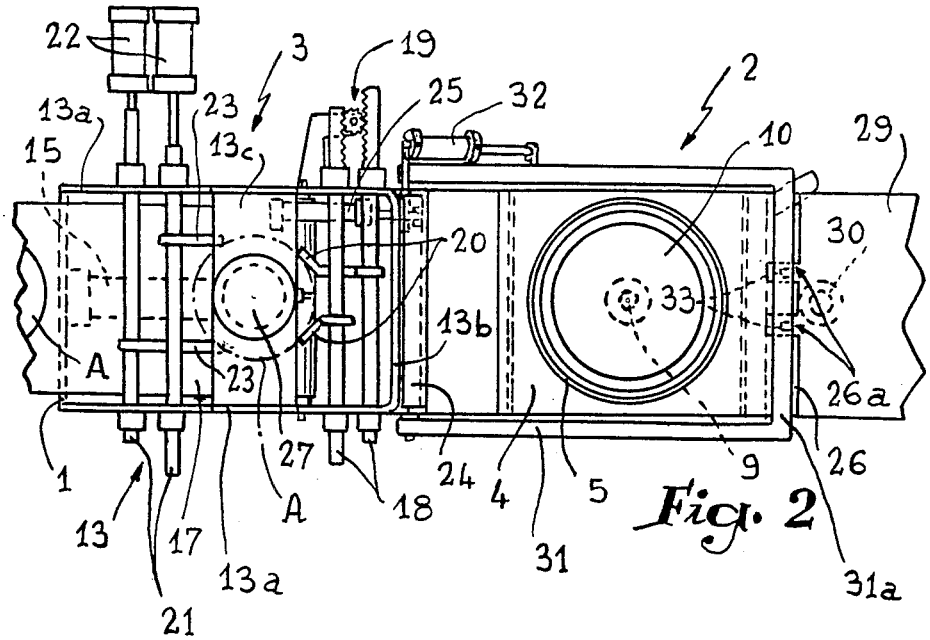
FIG. 2 is a corresponding plan view of FIG. 1.

The manipulator 3 comprises a carriage 13 provided at its base with shoes which allow its displacement on horizontal guides 14 of the frame 1. The reciprocating movement of the carriage 13 is effected with the aid of a pneumatic double-effect jack 15 of which the cylinder is fixed to the frame 1 while the mobile member is secured with the carriage via a vertical arm 16. It will be observed that the carriage 13 is formed by two lateral side elements referenced **13*a* in FIG. 2, connected to each other by a frontal cross-piece 13*b* and an upper cross-piece 13*c*, with the result that the carriage is open downwardly and rearwardly, thus allowing the bobbin such as A (FIG. 1), to be brought in succession by a conveyor belt 17**, to penetrate inside this carriage from the rear.

The carriage is equipped with a handling mechanism which firstly comprises two transverse spindles 18 (FIG. 2) which are slidably carried by the side elements **13*a* so as to be adjustable in axial position with the aid of a toothed device 19 which ensures simultaneous displacement of the spindles in opposite directions. This device 19 may in particular be constituted by a central pinion capable of being angularly adjusted with the aid of a crank or like tool, which pinion meshes with rack teeth formed on the projecting ends of the spindles 18. Each of the latter is secured with a transverse wing 20 sectioned so as to embrace the cylindrical wall of a bobbin 1, as will be described hereinafter, and it will be seen that adjustment of the spindles 18 allows modification of the mutual spaced apart relationship of the wings 20** and adaptation thereof to the diameter of the bobbins to be spun.

The handling mechanism also comprises two transverse rods 21 associated with two independent jacks 22 which ensure axial slide thereof in one direction or in the other. Each rod 21 carries a transverse arm 23 adapted, by sliding one and the other of said rods in opposite directions, to be applied against the wall of a bobbin A which is brought into abutment against the wings 20, as will be described hereinafter.

On the front cross-piece **13*b* of the carriage 13 is articulated the base of a pivoting flap 24 coupled to a movable jack 25 of the double-effect type. This flap 24 is thus capable of affecting either the position raised to a vertical as illustrated in FIG. 1, or a horizontal position, for which it obturates the upper opening made in the fixed table 26 which surrounds the rotating basket 5**.

Finally, it will be observed that, on the upper cross-piece **13*c* of the carriage 13 is fixed a vertical-axis jack 27 whose mobile member carries a pusher 28** of which the role will be indicated hereinbelow.

The operation of the manipulator 3 and of the centrifuge machine 2 will be described hereinafter, starting from the moment when this assembly is switched on.

Figure 3:
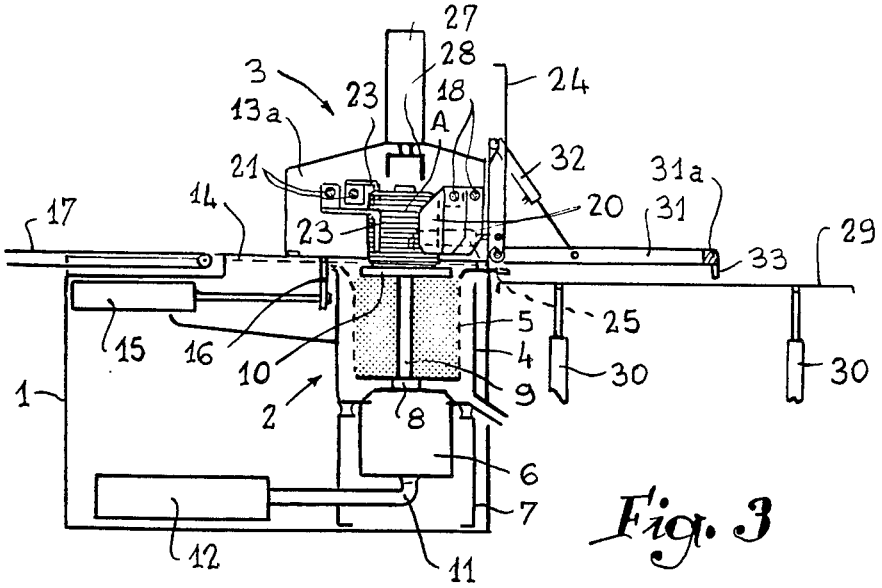
FIGS. 3 to 7 are schematic sections on a smaller scale illustrating the operation of the manipulator.

The first bobbin A to be spun, brought by belt 17, is moved against the wings 20 previously adapted in position. A feeler determines the arrival of this bobbin A and actuates the jacks 22, with the result that the arms 23 tighten on the bobbin A which is then secured with carriage 13. The jack 15 enters into action to push the carriage 13 up to the advanced position illustrated in FIG. 3, for which the axis of the upper jack 27 coincides with the axis of the rotating basket 5.

At that moment, the plate 10 associated with this basket 5 is in high position, with the result that the bobbin A secured between arms 23 and wings 20 of the handling mechanism is transferred onto the plate 10 by simply moving the jacks into spaced apart relationship.

Figure 4:
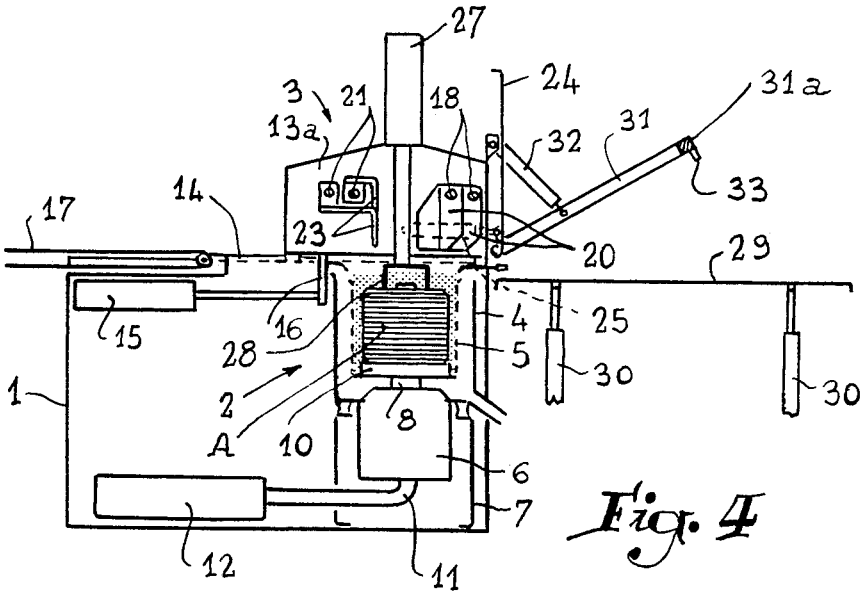

The jack 12 is then contracted in order to ensure lowering of the plate 10 inside the basket 5. This movement of descent is advantageously facilitated by actuation of the vertical jack 27 of which the mobile pusher 28 abuts against the upper part of the bobbin A which is thus driven by force in the basket 5 at the same time as the plate 10 (position of FIG. 4).

The jack 25 raises the pusher 28 and the carriage 13 is returned by jack 15 to the starting position. Jack 25 then lowers the flap 24 which, applied against the table 26, obturates the open upper part of the vessel 4, in the manner illustrated in FIG. 5. The bobbin A may then be spun by switching on motor 6.

Figure 6:
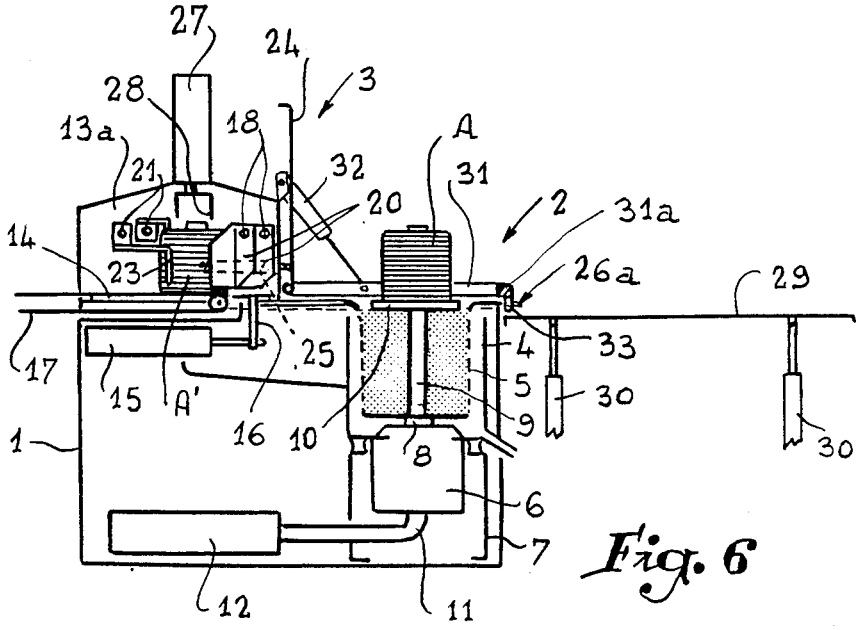
Figure 7:
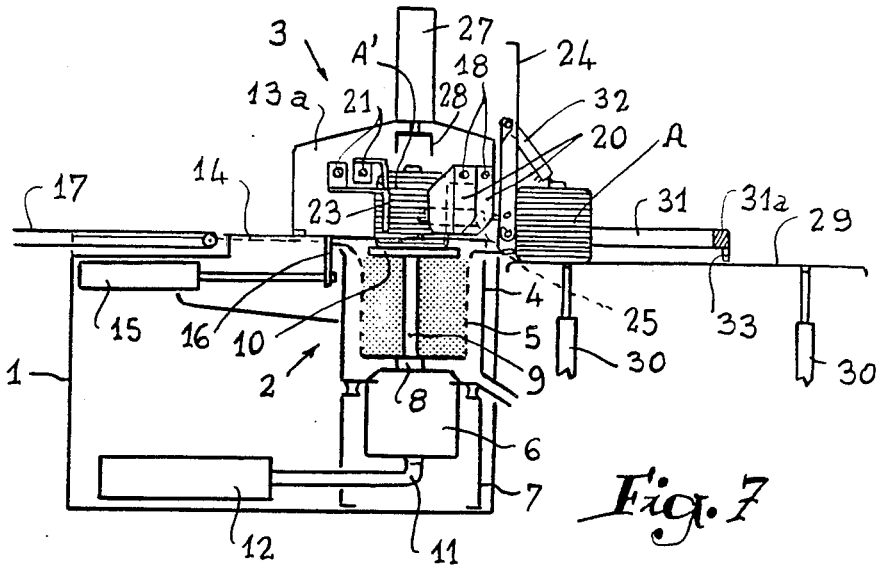

As soon as the spinning operation is finished, the pivoting flap 24 rises to the vertical (FIG. 6) at the same time as the jack 12 raises plate 10 with the spun bobbin A. At that moment, the jack 15 displaces the carriage 13 from the moved back position according to FIG. 6 to the advanced position according to FIG. 7, so that the flap 24 in raised position acts in the manner of a pusher to drive the spun bobbin A off of the plate 10. This bobbin A is collected on a front plate 29 disposed at the level of table 26 and associated with any appropriate evacuation device.

Figure 5:
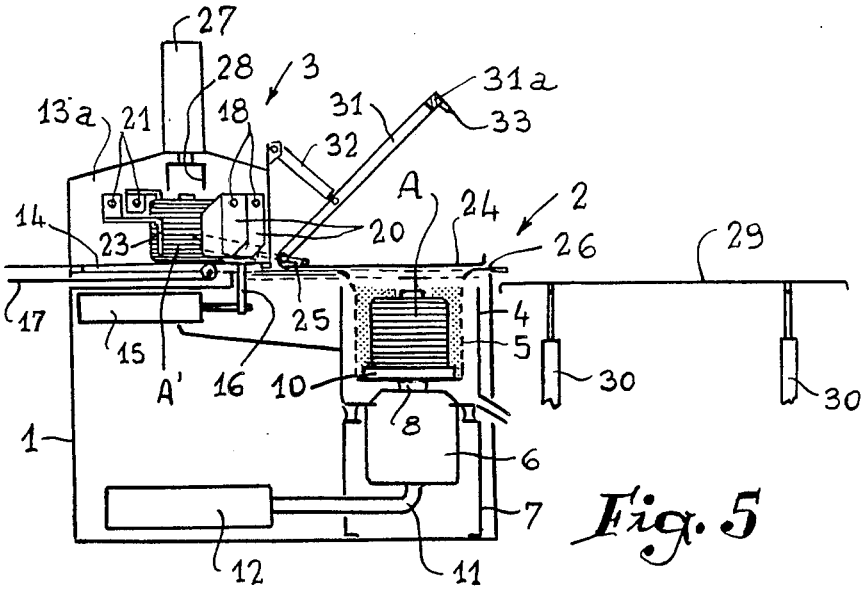

The spinning cycle of the bobbin A is then terminated, but meanwhile, when the carriage 13 was in moved into a back position according to FIG. 5, and a fresh bobbin to be spun, referenced A', has been brought by the belt 17 and has come into position against the wings 20. The arms 23 tightened on this bobbin A' which was transferred onto the mobile plate 10 when the carriage 13 passed from the moved back position of FIG. 6 to the advanced position of FIG. 7. The spinning cycles follow one another in this way and finally it suffices to supply the conveyor belt 17 with bobbins to be spun and evacuation of the spun bobbins from the plate 29.

Figure 8:
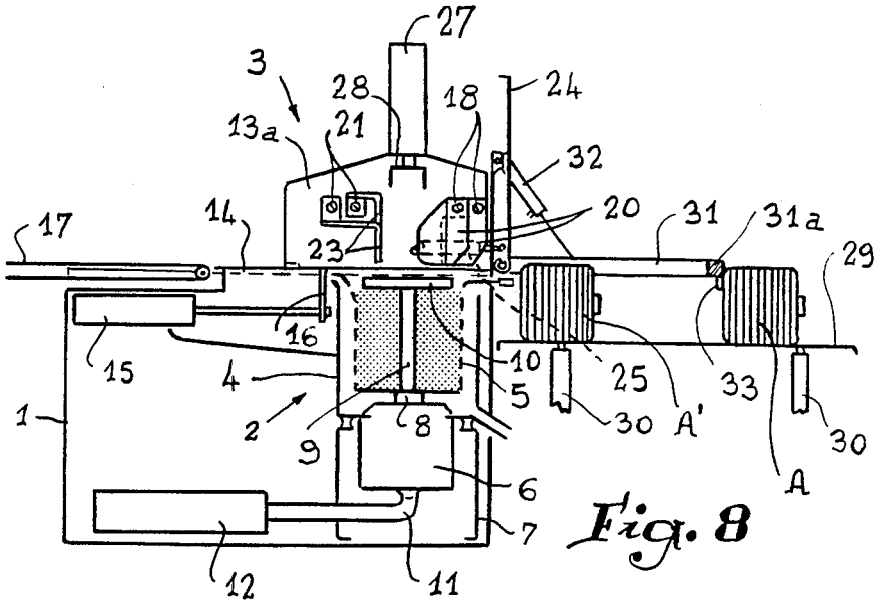
FIG. 8 is a schematic section similar to that of FIG. 7, but showing the evacuation of the spun bobbins in recumbent position.

In the foregoing description, it has been assumed that plate 29 was disposed at the height of table 26 so as to receive the bobbins in the vertical position. However, by acting on small adjusting jacks 30 associated with the plate 29, the latter may be disposed at a lower level so that the spun bobbins pivot when they are pushed by the flap 24. FIG. 8 illustrates such a variant and clearly shows the fact that the bobbins are collected on the plate 29 in the recumbent position.

However, it will be appreciated that the system would immediately be blocked since the spun bobbins would not be pushed onto the plate 29 and would drop on one another. To avoid this drawback, the carriage 13 is provided with a thrust frame 31 (FIGS. 1 and 2) disposed at the front of the carriage and assembled therewith in articulated manner in order to be moved angularly with the aid of a jack such as 32.

When, at the end of the spinning operation, the carriage 13 moves from rear to front, pushing by flap 24 the bobbin A' which has just been spun, the front cross-piece 31*a* of the frame 31, provided to this end with vertical fingers 33, pushes bobbin A collected earlier by plate 29, consequently clearing the front part of the plate which is then adapted to receive the following bobbin A' in the recumbent state, as illustrated in FIG. 8.

It goes without saying that, to allow the cross-piece 31*a* of the thrust frame 31 to pass above bobbin A when carriage 13 is returned from the advanced position to the moved back position (cf. FIGS. 4 and 5), the jack 32 is contracted to raise obliquely the frame which is lowered again only once the carriage 13 has arrived to its back position. Notches 26*a* (FIG. 2) are made in the front edge of the table 26 to allow the fingers 33 to be disposed as close as possible to the vessel 4.

FIG. 1 shows that the receiving plate 29 is adjusted with the aid of two distinct jacks 30, so as to enable the plate to be given an appropriate inclination when the bobbins to be treated present not a cylindrical profile as assumed up to the present, but a truncated profile. Consequently, any untimely slide of the bobbins on the plate is avoided.

Figure 9:
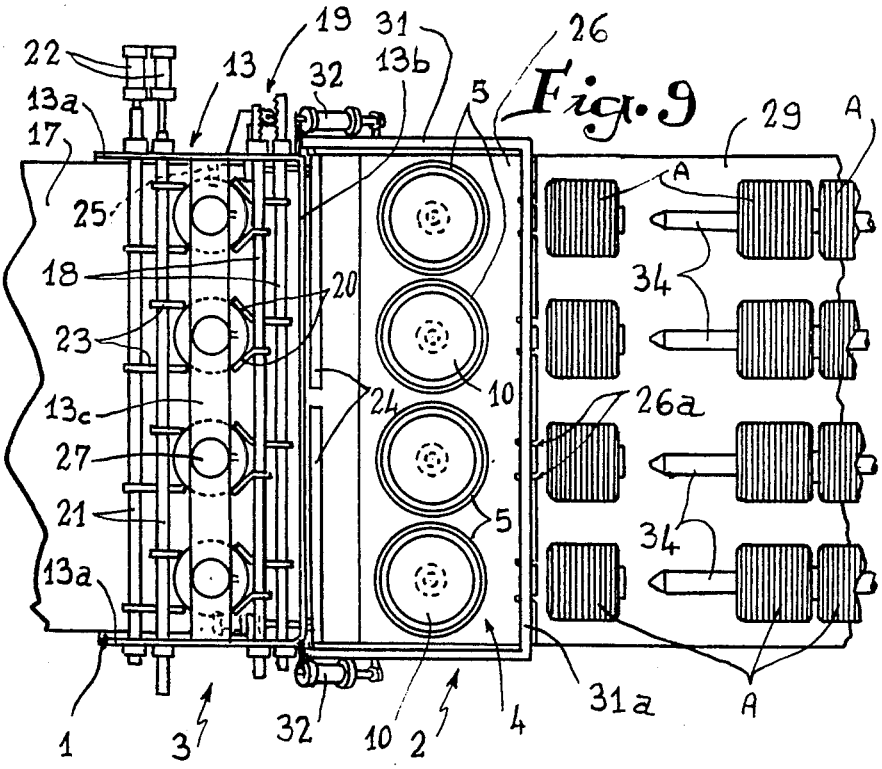
FIG. 9 is a plan view showing a manipulator according to the invention arranged for simultaneously supplying four centrifuge machines.

It should be observed that the invention lends itself particularly well to the production of installations with multiple centrifuges, of the type illustrated in FIG. 9 where it has been assumed that the assembly comprises four centrifuge machines, disposed along the same axis oriented transversely to the axis of displacement of the carriage 13 of the manipulator 3. This carriage 13 obviously presents a suitable width; its handling mechanism comprises, on the spindles 18 and on the rods 21, four pairs of stop wings 20 and four pairs of arms 23 in order to grip the four bobbins to be spun simultaneously conducted by the conveyor belt 17.

The manipulator according to FIG. 8 is equipped with a thrust frame 31 moved by two lateral jacks 32 and it has been assumed here that the spun bobbins collected in the recumbent state on the receiving plate 29 were engaged by the cross-piece 31*a* on support rods 34 oriented horizontally above said plate. It goes without saying that the plate 29 may be profiled to receive each row of bobbins, particularly comprising gutters in a number equal to that of the centrifuge machines.

It must, moreover, be understood that the foregoing description has been given only by way of example and that it in no way limits the domain of the invention which would not be exceeded by replacing the details of execution described by any other equivalents.

What is claimed is:

1. A manipulator apparatus for automatically conveying bobbins of material along a horizontal surface to centrifuge machines having at least one rotatable basket disposed below an opening in said surface in which basket the bobbins are subjected to centrifugal action and which basket includes a vertically movable plate for supporting the bobbins within the basket as the basket is rotated comprising a carriage horizontally reciprocally movable from a first position remote from the basket to a second position above the plate of the basket, said carriage including handling means for moving a bobbin from adjacent said first position to said second position to be received on the plate of the basket, and an articulated flap means movable between vertical and horizontal positions, means for moving said flap means into said horizontal position covering the opening into the basket when the bobbins are rotated and means for moving said flap means transversely of the opening to push bobbins away from the basket after the bobbins have been rotated therein.

2. The manipulator apparatus of claim 1, wherein said handling means includes two fixed wings forming stops for each of the bobbins to be rotated and two mobile arms movable away from each other to allow the bobbins to come into abutment against said wings, and means for moving said arms towards each other to tighten on each bobbin which is thus secured to said carriage.

3. The manipulator apparatus of claim 2, wherein said wings are carried by two parallel spindles, and associated with an adjusting device for adjusting the mutual positioning of said wings.

4. The manipulator apparatus of claim 2, wherein said arms are carried by two parallel rods, and associated with control means for insuring the synchronized axial displacement of said arms in opposite directions.

5. The manipulator apparatus of claim 2, wherein said carriage supports a vertical-axis jack having a reciprocating rod provided with a pusher, said pusher being engageable against the upper part of a bobbin to engage it by force with the plate of the basket.

6. The manipulator apparatus of claim 1, including a conveyor belt disposed adjacent said first position of said carriage to conduct the bobbins to be rotated successively to said handling means.

7. The manipulator apparatus of claim 1, including a receiving plate which extends from adjacent the opening above the rotatable basket in order to receive bobbins pushed by said flap means.

8. The manipulator apparatus of claim 7, wherein said receiving plate is carried by at least two secondary jacks, said secondary jacks being operable to adjust the height and inclination of said receiving plate.

9. The manipulator apparatus of claim 7, wherein said carriage includes a thrust frame arranged so as to push bobbins successively collected on said receiving plate, and control means for pivoting said thrust frame upwardly during displacement of said carriage from said second to said first position.

10. The manipulator apparatus of claim 9, wherein said thrust frame includes a front cross-piece having fingers which extend vertically in a downward direction.

* * * * *